US009027528B2

(12) United States Patent
Bittencourt

(10) Patent No.: US 9,027,528 B2
(45) Date of Patent: May 12, 2015

(54) ROTARY INTERNAL COMBUSTION ENGINE

(76) Inventor: Jose Fernando Bittencourt, Rio de Janeiro (BR)

( * ) Notice: Subject to any disclaimer, the term of this patent is extended or adjusted under 35 U.S.C. 154(b) by 871 days.

(21) Appl. No.: 12/738,420

(22) PCT Filed: Apr. 2, 2008

(86) PCT No.: PCT/BR2008/000095

§ 371 (c)(1),
(2), (4) Date: Aug. 11, 2010

(87) PCT Pub. No.: WO2009/049386

PCT Pub. Date: Apr. 23, 2009

(65) Prior Publication Data

US 2010/0300400 A1 Dec. 2, 2010

(30) Foreign Application Priority Data

Oct. 17, 2007 (BR) ..... 0704879

(51) Int. Cl.

| | |
|---|---|
| ***F02B 53/00*** | (2006.01) |
| ***F01C 1/344*** | (2006.01) |
| ***F01C 19/02*** | (2006.01) |
| ***F01C 19/12*** | (2006.01) |
| ***F01C 21/00*** | (2006.01) |

(Continued)

(52) U.S. Cl.

CPC ..... *F01C 1/3442* (2013.01); *F01C 1/22* (2013.01); *F01C 19/02* (2013.01); *F01C 19/12* (2013.01); *F01C 21/008* (2013.01); *F01C 21/0809* (2013.01)

(58) Field of Classification Search

USPC ..... 123/240, 241, 243, 236, 200; 418/241, 418/61.1, 138

See application file for complete search history.

(56) References Cited

U.S. PATENT DOCUMENTS

| | | | | |
|---|---|---|---|---|
| 1,004,696 | A * | 10/1911 | Schoeck | 123/243 |
| 1,636,799 | A * | 7/1927 | Berntsen | 123/241 |
| 3,181,510 | A * | 5/1965 | Hovey | 123/240 |

(Continued)

FOREIGN PATENT DOCUMENTS

DE 19756105 A1 * 12/1998 ..... F01C 1/34

OTHER PUBLICATIONS

International Search Report and Written Opinion dated Jan. 16, 2009 for International Application No. PCT/BR2008/000095, International Filing Date Apr. 2, 2008 (6-pages).

(Continued)

*Primary Examiner* — Thomas Denion
*Assistant Examiner* — Thomas Olszewski
(74) *Attorney, Agent, or Firm* — Christopher & Weisberg, P.A.

(57) ABSTRACT

A rotary engine having a main block with a cylindrical cavity, a rotor having at least one divisor having at least one ring for rotably engaging a main axis. The divisors having an edge slidably abutting the internal surface of the cylindrical cavity. The rotor having at least one bearing for engaging the cams of the main axis. The rotor having at least one transversal fissure having a trapezoidal profile and a transversal cylindrical opening. The transversal cylindrical opening having at least one pivoted sliding guide for movably holding the divisors at an angle of 90 degrees between the edge the divisors relative to the internal surface of the cylindrical cavity during a complete 360-degree turn of the rotor. The rotor having a planetary gear interfering with a stationary satellite gear of the main axis and having a diameter wider than diameter of the stationary satellite gear.

14 Claims, 17 Drawing Sheets

(51) Int. Cl.
*F01C 21/08* (2006.01)
*F01C 1/22* (2006.01)

(56) References Cited

U.S. PATENT DOCUMENTS 3,200,796 A * 8/1965 Stoupa et al. ..... 418/61.1
3,381,668 A * 5/1968 Agren ..... 123/240
3,451,381 A * 6/1969 Armstrong ..... 123/243
3,682,143 A * 8/1972 Leas ..... 123/240
3,747,573 A * 7/1973 Foster ..... 123/202
3,951,112 A 4/1976 Hunter
4,024,840 A * 5/1977 Christy ..... 123/236
4,314,533 A * 2/1982 Barata et al. ..... 123/242
4,354,462 A * 10/1982 Kuechler et al. ..... 123/241
6,484,687 B1 * 11/2002 Duncan ..... 123/241
6,550,442 B2 * 4/2003 Garcia ..... 123/243
7,077,098 B2 * 7/2006 Shuba ..... 123/240
7,192,264 B2 * 3/2007 Viitamaki ..... 418/265
2002/0059921 A1 * 5/2002 Arnold ..... 123/559.1

OTHER PUBLICATIONS

Office Action dated Oct. 20, 2011, issued in Canadian National Stage Patent Application Serial No. 2,702,731 corresponding to International Application No. PCT/BR2008/000095, International Filing Date: Apr. 2, 2008 consisting of 2 pages.

* cited by examiner

FIG.1 (Prior Art)
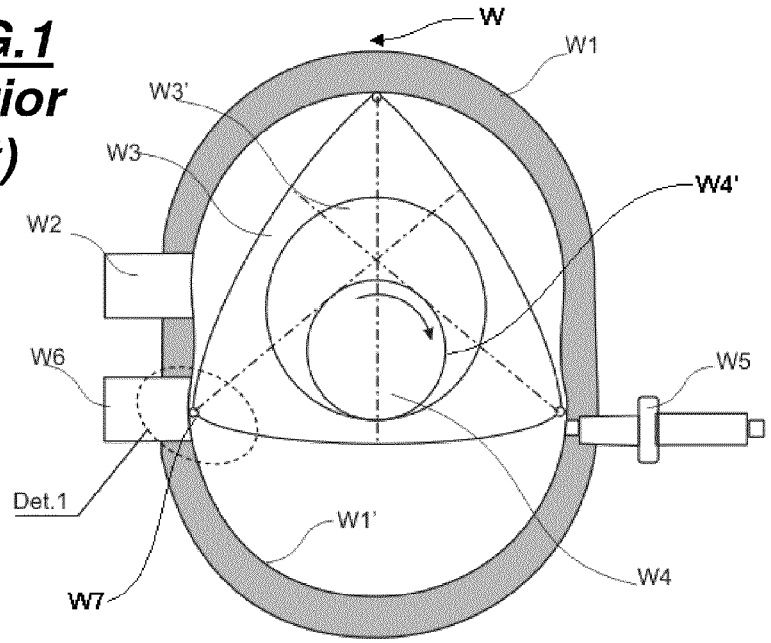
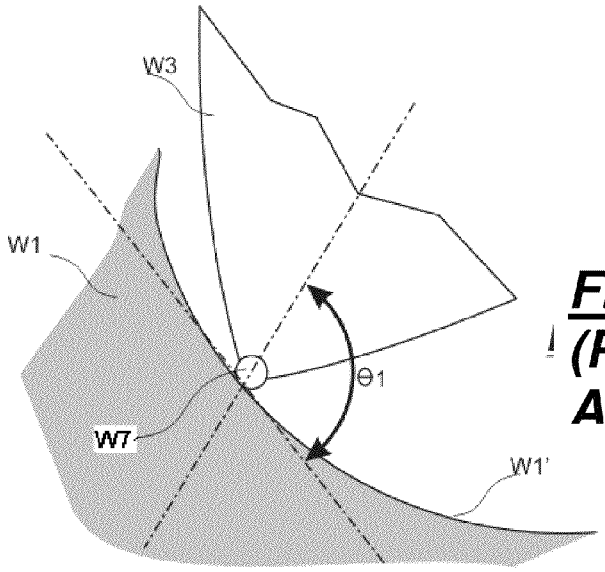
FIG.2 (Prior Art)

FIG.6.1
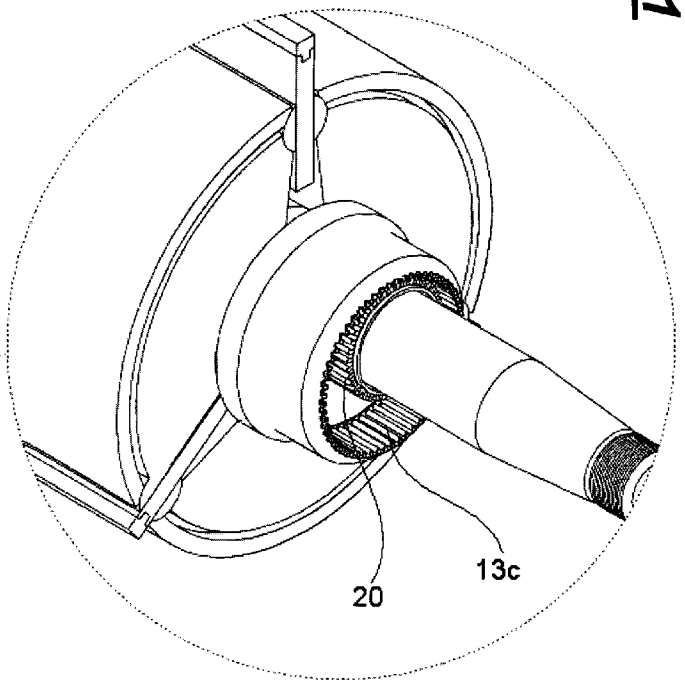
FIG.6
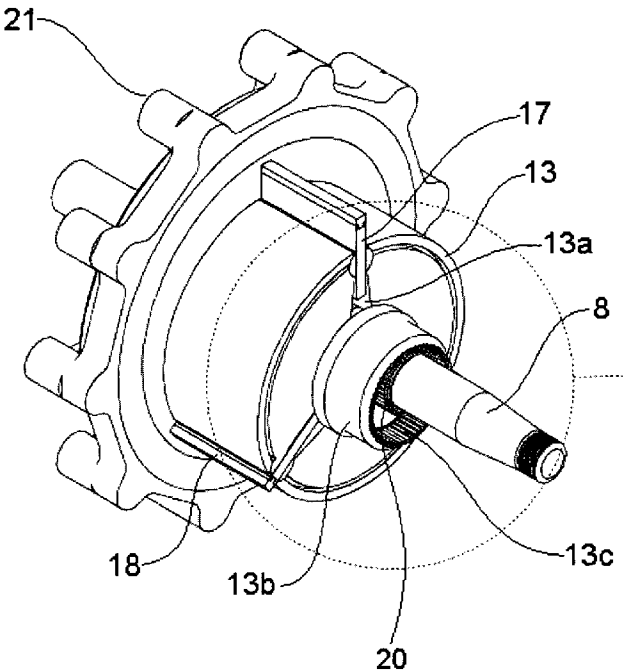

ROTARY INTERNAL COMBUSTION ENGINE

CROSS-REFERENCE TO RELATED APPLICATIONS

This application is a Submission Under 35 U.S.C. §371 for U.S. National Stage Patent Application of International Application Number: PCT/BR2008/000095, filed Apr. 2, 2008 entitled "ROTARY INTERNAL COMBUSTION ENGINE," which claims priority to Brazilian Application Serial No: PI0704879-3, filed Oct. 17, 2007, the entirety of both which are incorporated herein by reference.

FIELD OF THE INVENTION

The present subject-matter relates to internal combustion engines, particularly to internal combustion engines known as "rotary engines".

BACKGROUND OF THE INVENTION

Internal combustion engines are machines that provide mechanical energy and functionality to products such as industrial equipment and vehicles. They are fundamentally based on the combustion of a combustible/comburent mixture inside a chamber, which can be ignited by sparks or high temperature.

Types of internal combustion engines: among the engines known as economically reliable and widely commercialized, the engines that present a significantly high demand are the ones applied to vehicles:

a) Two-stroke-cycle engine: an engine that provides high rotation and, consequently, high power. Its operation may be understood by the two-stroke-cycle necessary to conclude a complete turn of the crankshaft. A disadvantage of this type of engine is that to obtain high power, it has a high consumption of combustible fuel. This results in a high emission rate of toxic gases and particulate matter in the atmosphere, which makes this type of engine unsuitable for use in ecologically friendly products.

b) Four-stroke-cycle engine: provides high power at relatively low rotations, when compared to the two-stroke-cycle engine, but its manufacturing requires a great number of static and dynamic parts. Its operation requires two complete turns of the crankshaft to complete a cycle. Despite being more economical from a point of view of fuel consumption, these engines present a high vibration level, high mechanical losses, as well as a great number of component parts, which means this type of engine has higher manufacturing costs, as well as high maintenance costs and a high probability of failure.

c) Diesel engine: this type of engine operates based on the absorption of atmospheric air inside the combustion chamber, where its internal temperature is increased to more than 600° C., and where the combustible (diesel) is directly injected inside the chamber and starts the explosion process. Contrary to piston rotary engines, and non-diesel two-stroke-cycle and four-stroke-cycle engines, this type of engine does not need a spark system to start the combustion process. However, they produce a high emission rate of gases and particulate matter in the atmosphere. They also present very intensive vibrations and they necessarily need a construction that makes them heavy and noisy, mainly due to the high compression rates.

d) Rotary engine: this type of engine has a simpler design compared to piston rotary engines. A rotary engine has a rotor (or rotors) that rotates inside a jacket. Rotary engines are generally extremely compact and light. However, application to vehicles has faced regulatory restrictions largely due to its combustible fuel consumption and pollutant emission rates.

Other types of engines include, jet engines; turbines (gas and aeronautic) and rocket engines.

Several embodiments of rotary engines exist that use the concept of an internal combustion engine. There is a lot of technical literature that demonstrates that almost all of these embodiments present the basic concept of the rotary engine idealized, patented and constructed by Felix Wankel in the 1940s. We can observe generally, that all these "Wankel" engines present the same problem of non-constant perpendicularity between the chamber divisors and the jacket. This considerably impairs the sealing and internal cleaning, which results in a dirty and non-economical engine, that prevents the large scale production of these engines.

Wankel engine: this rotary engine has a single jacket, which describes a cavity whose profile approximately represents a figure 8-shape, which contains an assembled rotor, having an approximately triangular shape that in a general way has the function of a piston component, used in conventional alternative combustion engines. The rotor is assembled on a rotational axis, mainly an equivalent axis to a crankshaft component.

In order to assure the necessary sealing for an efficient explosion cycle, a discreet sealing element is added on the end of each edge formed in the triangular rotor.

Operational principle of the Wankel engine: this engine presents a four-stroke-cycle: intake, compression, combustion and exhaust. In order to obtain this cycle the triangular rotor turns eccentrically in relation to the axis of the crankshaft component (main axis), making the edges of the triangular rotor describe a movement that is equidistant from the wall of the cavity (or jacket) of the chamber.

This eccentric displacement of the triangular rotor results in an increase or decrease of the space between the convex sides of the rotor and the wall of the cavity of the jacket. When this space is increasing, a combustible/comburent mixture is injected inside the chamber and is compressed during the subsequent decrease of the volume of the chamber, thus, creating the cycle, mainly the classical four-stroke-cycle previously mentioned.

Advantages of the Wankel rotary engines: several positive characteristics can be highlighted: reduced vibration levels during its operation, due to its reduced number of interactive components, as well as the absence of movement inversion of defined components in the mechanism;

Due to its reduced number of component parts, it presents a compact assembly that makes it easier to assemble in equipment and/or vehicles and also allows for a lower gravity center of the vehicle, which in turn allows an increase in the degrees of freedom in the aerodynamic nature of the designs;

It presents superior rotation and torque;

It may present combustible consumption similar or equivalent to piston rotary engines, and A more flexible power curve, when compared with the power curve of piston rotary engines.

Disadvantages of the Wankel rotary engines: Wankel rotary engines present the following negative characteristics:

Impairment of their reliability due to deficient sealing systems on the edges of the triangual rotor and walls of the cavities of the chamber (jacket);

Impairment of the durability due to its deficient sealing between static (jacket) and movable (rotor triangular/sealing) components that results in the formation and accumulation of particulate matter;

Excessive engine heating due to the great internal area of the chamber, resulting in great heat exchange between the hot gas and the housing (jacket);

A limited number of chambers and a unique possible relation between the fixed gear and the dynamic gear, fixed to the rotor; and It necessitates a high-precision assembly of the involved components, with very restrictive tolerances—practically nominal measures.

As we can see from the above description, it is a fact that the solution of the rotary "Wankel" engine accomplishes the primary objective, which is converting thermal energy in mechanical energy to provide movement to industrial equipment or a vehicle. However, it is a fact that these solutions present deficient aspects, mainly the obtainment of distinct reliability, durability and quality.

Current rotary engines have a deficient sealing system between the chambers, i.e., their form does not allow an ideal operation of the seals that separate the chambers, impairing the sealing at the contact point among the static and dynamic components of the engine. The figure 8-shape profile of the jacket cavity does not permit constant perpendicularity between the discreet stem of the sealing element and the wall of the cavity of the jacket in its whole outline, where this perpendicularity only occurs in discreet points of the cavity, when the rotor describes its eccentric movement. Thus, there are moments when the sealing between the discreet stem of the sealing element and the wall of the cavity of the jacket is deficient, since the known sealing element presents design and functional characteristics that limit its efficiency. In the case of the Wankel engine, for example, this sealing element presents four unique conditions of perpendicularity between the discreet sealing element and the cavity of the jacket (as will be discussed below). It can be seen that the contact between the discreet sealing element in the edge of the rotor and the cavity (chamber), in the complete sequence of the cycle, is oblique and forms several contact angles. Such occurrence significantly impairs the efficiency of the sealing between the chambers.

Thus, the limited efficiency of the sealing system compromises the performance of the internal chambers during the classical cycle of intake, compression, explosion and exhaustion, a fact that produces several other functional problems with durability, efficiency, reliability, consumption and pollutant emission.

Therefore, there is a need for a rotary engine having the desirable attributes of excellent tightness between chambers, durability, reliability with high yield, low mechanical losses, and whose manufacture is industrially and economically possible for all classes of engines that present the concept of transforming energy from a chemical reaction to mechanical energy through the cycle of intake, compression, explosion/expansion and exhaust/flow of a combustible/comburent mixture inside the combustion chambers, which presents superior or equal operational life when compared to the traditional piston rotary engines.

There is also a need for a rotary engine that offers lower consumption of combustible that translates in a reduction of the gas volume and particulate matter exhausted by the functional cycle of the engine.

There is also a need for a rotary engine that presents low levels of noise and vibration, providing comfort to the users of the equipment which is driven by the engine, mainly to drivers and passengers of vehicles, or to operators of equipment.

There is also a need for a rotary engine that can be manufactured at a cost almost equivalent, or even lower than the cost of manufacturing rotary engines, such as the "Wankel"-type rotary engines.

SUMMARY OF THE INVENTION

The present application seeks to provide an improved Wankel rotary engine and additionally provides: a) Equivalent and/or improved general performance of the engine; b) Distinct durability due to a limited wearing of its component parts (movable or static), excellent sealing among the chambers, which significantly reduces the mechanical losses and provides excellent internal cleaning; c) For items "a" and "b", respectively, a reduction in the cost and frequency of maintenance, both preventative and corrective; d) Reduction of the combustible consumption whether it be petroleum-based or bio-combustible, mainly alcohol (from sugar-cane, corn or similar sources); e) Minimization of the emission of pollutant gases and particulate matter in the atmosphere; f) A greater flexibility of engine specifications, where the same one is adequate for any type of engineering specification, in accordance with the engine application; and g) Equivalent or lower industrial cost when compared to commercialized rotary engines, since the same materials, machines and tools are used in the manufacturing of its component parts.

The present application provides a rotary engine with an efficient sealing system between the static component part (jacket that coats the internal part of the cavity of the motor housing) and the movable component part (divisors of chambers), where a unique condition of perpendicularity during all functional cycle exists in the contact region between the jacket and the sealing element at the end of each chamber divisor. In order to obtain the condition of perpendicularity between the sealing element at the end of the chamber divisors and the internal wall of the jacket that coats the cavity of the housing, the cavity/jacket has a geometrical cylindrical shape.

The present application further provides, a rotor component, which is assembled over the cam of a main axis, of crankshaft type, that may take any geometrical shape, such as cylindrical, elliptical or polygonal. The rotor presents fissures that have a cylindrical cavity in which sliding guides act as movable connectors between the divisors and the rotor. The number of divisors may vary in accordance with the engineering specifications of a specific application of the engine.

The divisors present a rectilinear profile and have a stem with bearings, such as rings, in their base. The divisors are slidably held by pivoted guides that are assembled in the cylindrical cavity of rectilinear channels in the body of the rotor. The center of the bearing of the divisors coincides with the center of the jacket and with the center of the main axis, of crankshaft type. The bearings, allow the divisors to freely rotate, and the pivoted guides keep their end perpendicular in relation to the internal surface of the jacket during the whole cycle of the rotor/divisors set.

The divisors set (17) describe a movement of concentric rotation in relation to the internal surface of the jacket, and their end remains in a perpendicular position in relation to the internal surface of the jacket during the 360° turn of the rotor/divisors set, while they perform the phases of intake, compression, explosion/expansion and flow/exhaust.

The center of the rotor orbits around the center of the jacket, performing translation movements (orbit whose center coincides with the center of the jacket and also with the primary center of the main axis, of crankshaft type). The rotor also turns around its own axis. The rotor's rotation center coincides with the cam center of the main axis, of a crankshaft type. The translation and rotation movement of the rotor is driven by the cam of the main axis and is a result of the interference of the satellite gear, fixed to the rotor, with the stationary planetary gear, fixed to a static component (anterior or posterior plate) or to another static component of the rotary engine.

The synchronized translation and rotation movements of the rotor make it deviate and bring it near to the internal face of the jacket, increasing and reducing the volume of the chambers, for each 90°-angle turn of the rotor.

Each 90°-angle turn of the rotor around its own axis makes the main axis, of a crankshaft type rotate around its own axis in a 270°-angle. The result is that for each 360°-turn of the rotor the main axis rotates around its own axis in a 1,080°-angle, i.e., 3 complete turns.

The three chambers sequentially define the four classical phases of an internal combustion engine. When the rotor deviates from the jacket, the corresponding chamber tends to increase its volume, and the counter-clockwise movement of the rotor performs the phase of intake at the point corresponding to 180°, or 09h00 if we consider the dial as a clock. After this phase, the counter-clockwise movement of the rotor performs the phase of compression/explosion at 270° or 06h00. After this phase the counter-clockwise movement of the rotor performs the phase of expansion at 360°/0° or 03h00. After this phase the counter-clockwise movement of the rotor performs the phase of exhaust (flow) and restarts the phase of intake for the same chamber at 90° or 12h00. The four phases occur sequentially in each of the three chambers, in the same angular positions, during a complete turn of the rotor around its own axis.

Such a cycle is only applicable with a relation between the planetary and stationary satellite gears of 1:1.5 number of teeth and when three chambers are used. The present invention is not limited to this relation and/or to this number of chambers, since the present invention allows "n" relations between the planetary and stationary satellite gears, in conjunction with "n" number of chambers, performing "n" complete cycles of explosion, to each complete 360°-turn of the rotor.

The present invention provides a rotary engine in which it is possible to define "n" divisors to define "n" chambers for the cycle of intake, compression, explosion/expansion and flow and "n" cycles of these four complete phases to each complete turn of the rotor (in the Wankel engine only three chambers are defined, and it does not allow variations of this number). The present invention also allows parallel assemblage of engines, defining arrangements with several engine sets, driving a main axis, of crankshaft type.

Applicant wants to highlight that the present invention, may be applied to all types of engine (two-stroke or four-stroke-cycle).

BRIEF DESCRIPTION OF THE DRAWINGS

FIG. 1 is an illustrative representation of the prior art Wankel rotary engine showing an interaction among the main dynamic components and the cavity of the jacket.

FIG. 2 is an amplified detailed representation of the contact point between the discreet sealing element, installed on the rotor edge and the jacket surface, in the prior art Wankel rotary engine, showing a condition of non-perpendicularity between the sealing element and jacket surface.

FIG. 6 is a perspective view showing one embodiment of the new rotary engine, without the posterior closing plate, without the main block and without the jacket, revealing its dynamic parts and the planetary gear.

FIG. 6.1 is an amplified detailed perspective view showing the contact between the planetary gear and the stationary satellite gear fixed to the rotor.

FIG. 14.1 is an amplified detailed view of one embodiment of the new rotary engine showing the position of the divisor in relation to the axial wall of the fissure defined in the body of the rotor and the position of the divisor in relation to the internal surface of the jacket in the final phase of maximal intake.

FIG. 15.1 is an amplified detailed view of one embodiment of the new rotary engine showing the position of the divisor related to the axial wall of the fissure defined in the body of the rotor and the position of the divisor in relation to the internal surface of the jacket in the phase of compression.

FIG. 16.1 is an amplified detailed view of one embodiment of the new rotary engine showing the position of the divisor in relation to the axial wall of the fissure defined in the body of the rotor and the position of the divisor element in relation to the internal surface of the jacket in the phase of maximal compression and explosion.

FIG. 17.1 is an amplified detailed view of one embodiment of the new rotary engine showing the position of the divisor in relation to the axial wall of the fissure defined in the body of the rotor and the position of the divisor in relation to the internal surface of the jacket in the medium phase of expansion.

FIG. 18.1 is an amplified detailed view of one embodiment of the new rotary engine showing the position of the divisor in relation to the axial wall of the fissure defined in the body of the rotor and the position of the divisor in relation to the internal surface of the jacket in the phase of maximal expansion and initial phase of depletion.

FIG. 19.1 is an amplified detailed view of one embodiment of the new rotary engine showing the position of the divisor in relation to the axial wall of the fissure defined in the body of the rotor and the position of the divisor in relation to the internal surface of the jacket in the final phase of depletion and start of intake.

DETAILED DESCRIPTION OF THE INVENTION

Figure 3:
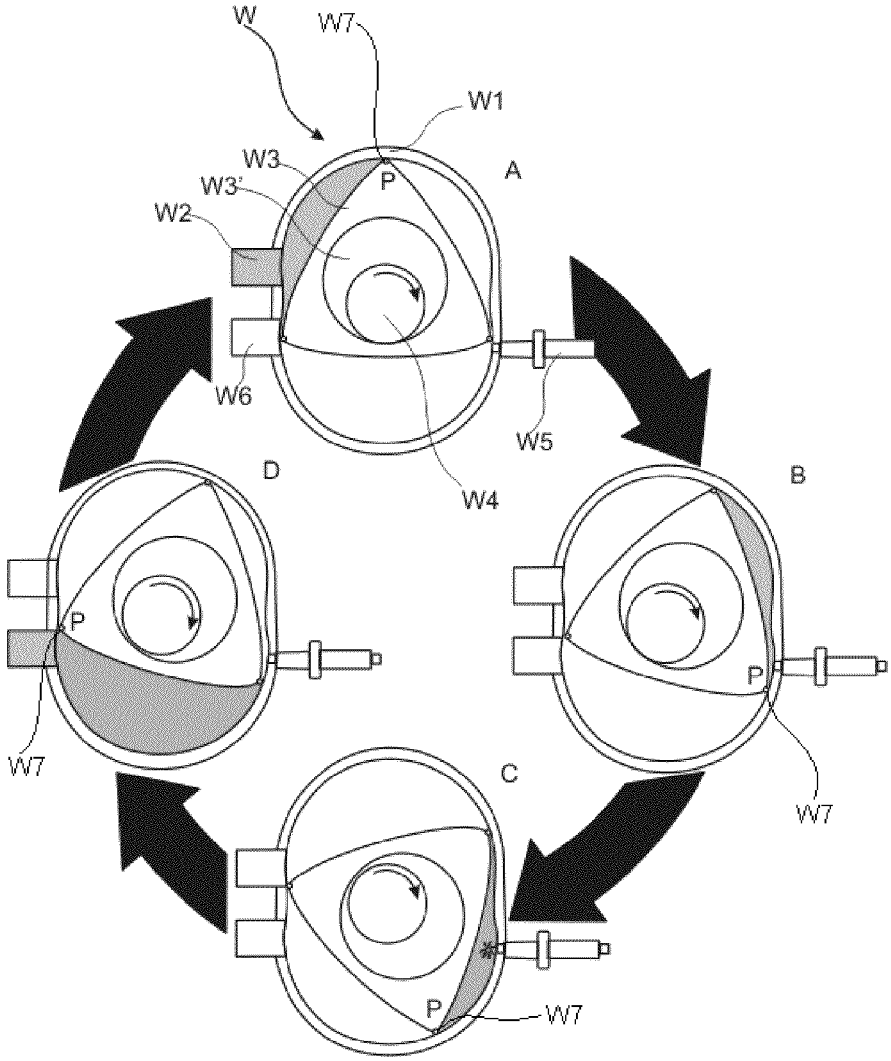
FIG.3 (Prior Art)
FIG. 3 is an illustrative representation of the cycles of intake, compression, explosion/expansion and exhaustion, performed by the prior art Wankel rotary engine, showing the variable oblique angles of contact formed between the sealing elements and the inside surface of the jacket, during the complete cycle of the rotor.
Figure 8:
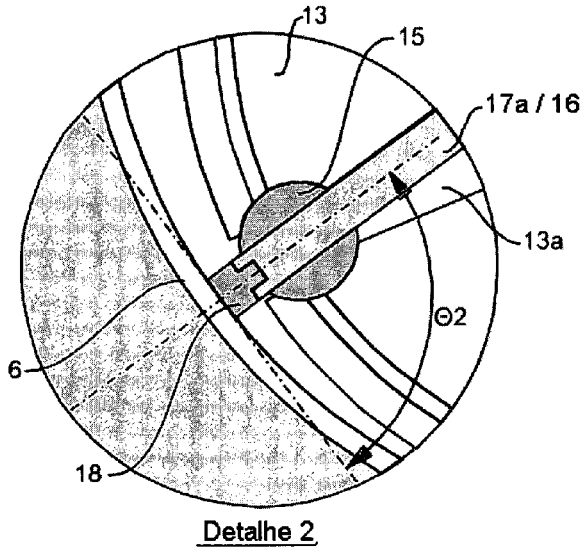
FIG. 8 is an amplified detailed representation of the contact point between the sealing elements on the end of the divisors and the internal surface of the jacket in one embodiment of the new rotary engine, showing the condition of perpendicularity between the sealing elements and the internal surface of the jacket during the complete cycle of the rotor.
Figure 9:
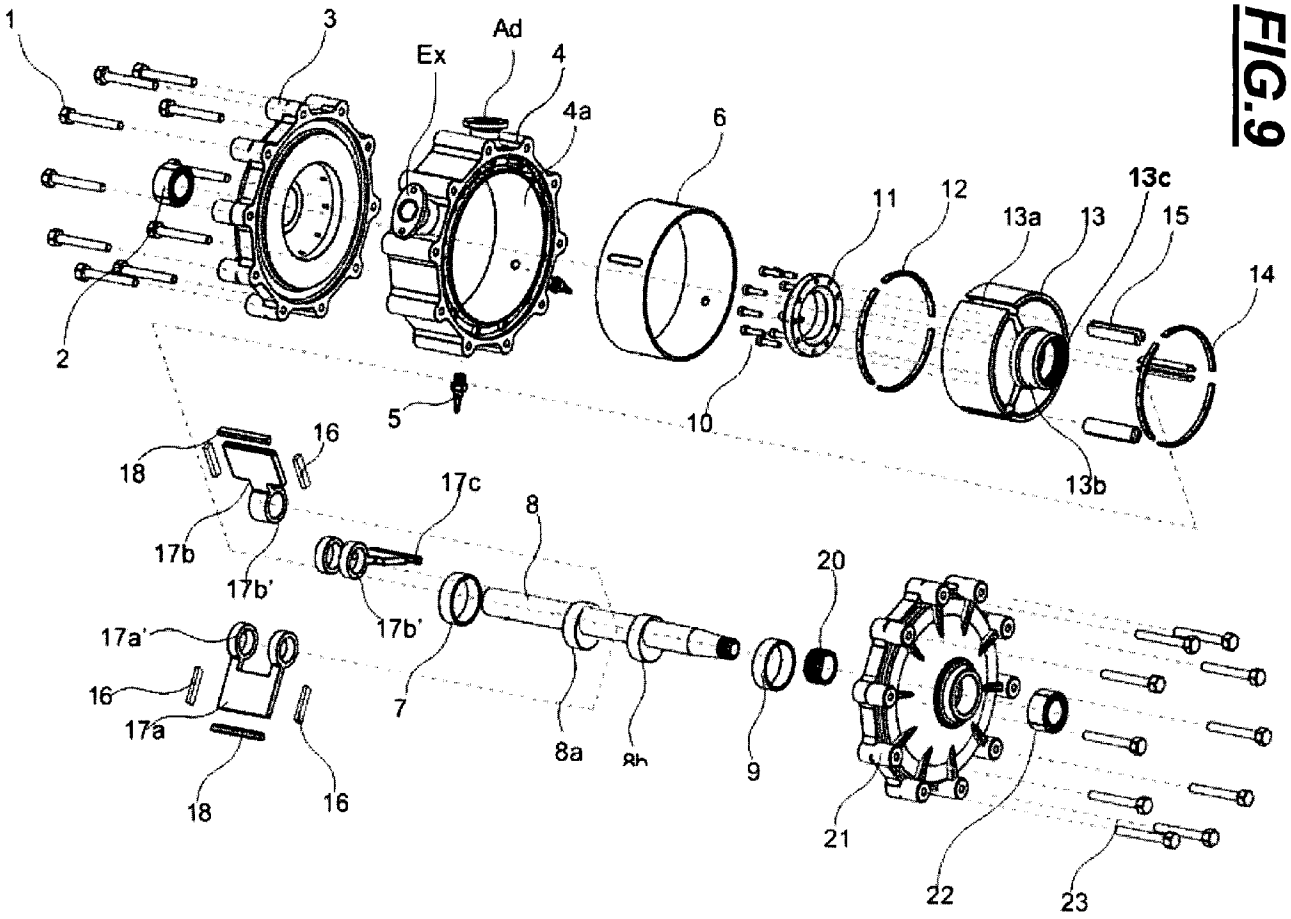
FIG. 9 is an exploded frontal perspective view showing one embodiment of the new rotary engine, revealing all static and dynamic parts that form the rotary engine.

A Wankel engine is presented in FIGS. 1 to 3. With reference to FIG. 1, the Wankel engine (W) has a jacket (W1), which describes a cavity (W1') with an approximate figure 8-shape, which presents in its body an access (W2) for the air/combustible mixture and an access (W6) for the exhaust gases, as well as a spark plug (W5). In the interior of cavity (W1') is assembled a triangular rotor (W3) that has an internal cavity (W3'), mainly a toothed cavity (the teeth are not represented), which interacts with the static toothed segment (W4') (the teeth are not represented) of a rotation axis (W4) of crankshaft type. Additionally, on the edges of the triangular rotor (W3) sealing elements (W7) are assembled.

The deficient aspect of the Wankel rotary engine (W) is that when the triangular rotor (W3) describes a rotation movement in relation to the rotation axis (W4), the tangency between the sealing element (W7) and the wall of the cavity (W1'), has an angle (Θ1) that is oblique and variable from positive to negative and not perpendicular during the entire cycle (see FIG. 3, where the positions of the sealing element (W7) are highlighted). This prevents the sealing element (W7) from performing the internal cleaning of the cavity (W1'), and also makes tightness between the chambers deficient, which is fundamental for the engine to present efficiency, durability and reliability.

Figure 4:
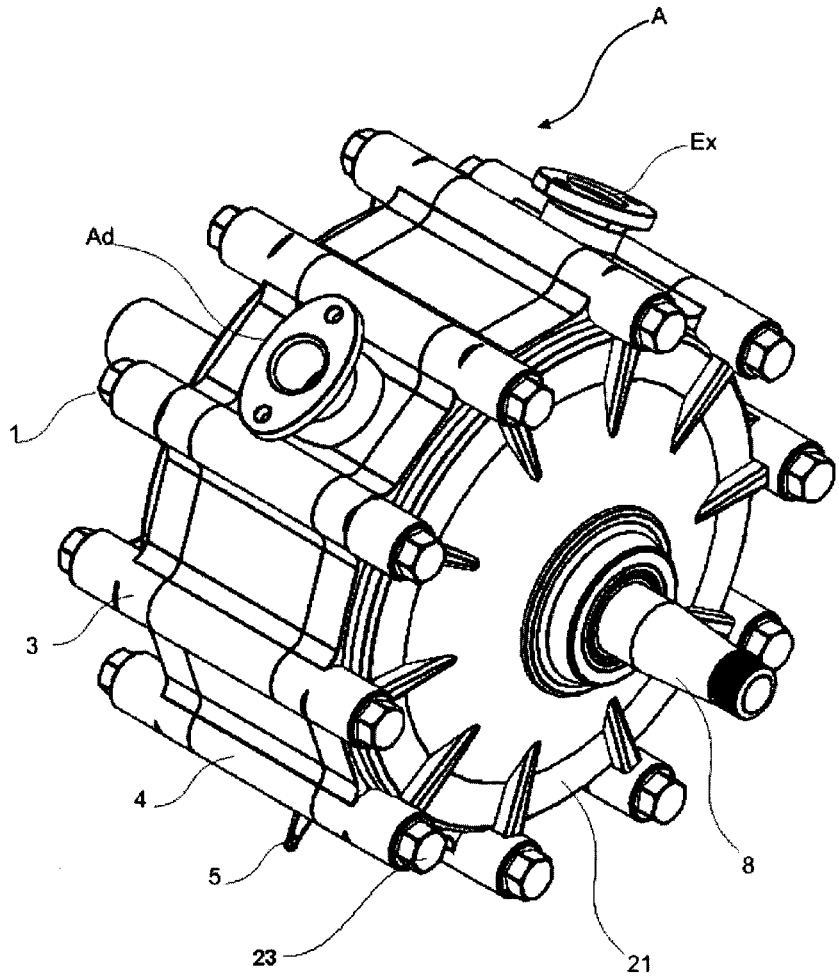
FIG. 4 is a perspective view showing the closed rotary engine, in one embodiment, showing its predominant cylindrical and compact profile.
Figure 5:
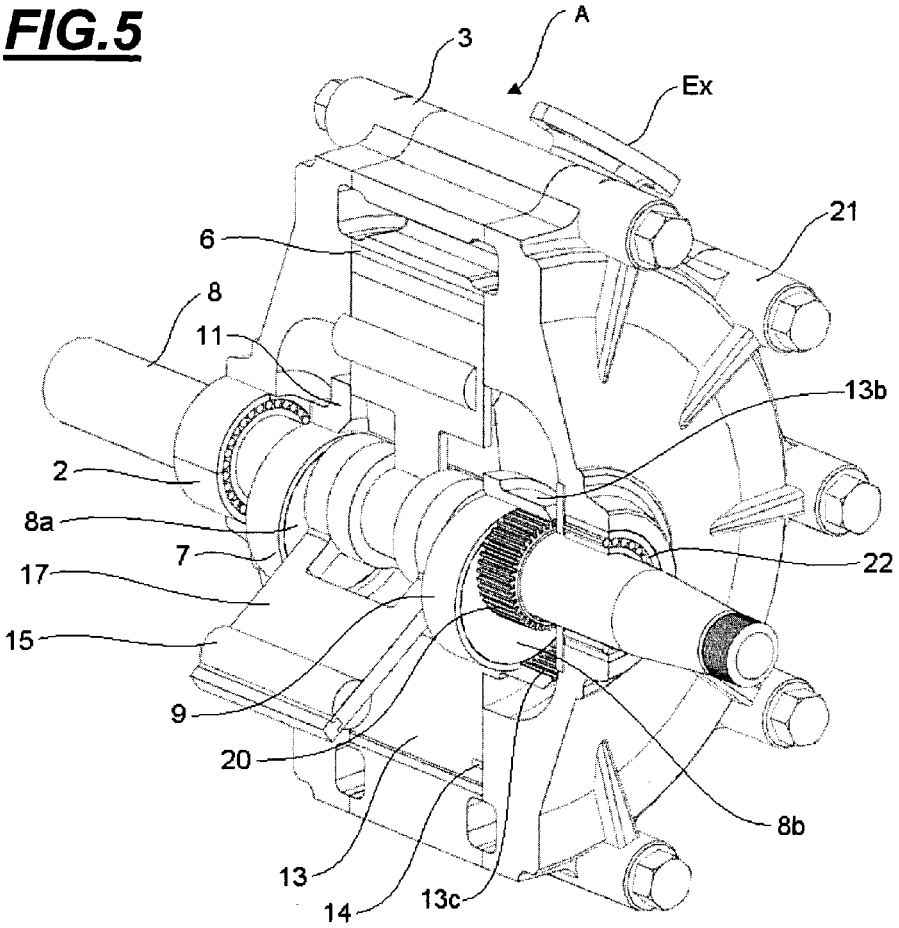
FIG. 5 is a perspective view showing the internal components of one embodiment of the new rotary engine.

With reference to FIGS. 4 and 5, rotary engine (A) presents an external shape of a typically cylindrical solid, which is derived from the cylindrical shape of the jacket (6).

Rotary engine (A) has an anterior plate (3), which has the function of providing anterior closing of main block (4). Main block (4) has the function of providing housing to the static and dynamic components that form the mechanism of rotary engine (A). Additionally, main block (4) has a posterior plate (21), which has the function of providing posterior closing of main block (4).

Main block (4) has an intake nozzle (Ad) and a depletion nozzle (Ex), which respectively have the function of receiving the combustible/comburent mixture and to exhaust the burned gases. Main block (4) has a spark plug (5), which has the function of provoking sparks to ignite the combustible/comburent mixture during the explosion phase of the functional cycle of the rotary engine (A). Finally, main block (4) has a cylindrical cavity (4*a*), which is adequate for the assembly of rotor (13) and of the other dynamic components, such as: divisors set (17), pivoted sliding guides (15), radial seals (18) between chambers, axial seals (16), etc.

The union between main block (4) and anterior plate (3) is done through a plurality of fixation elements (1), such as hexagonal head bolts. Similarly, the union between the main block (4) and posterior plate (21) is done through the use of a plurality of fixation elements (23), such as hexagonal head bolts.

With reference to FIG. 5, the posterior end of the main axis (8) passes through fixed posterior bearing (22) in posterior plate (21). Similarly, the anterior end of main axis (8) passes through fixed anterior bearing (2) in anterior plate (3).

Main axis (8), of crankshaft type, is formed by an axis and a pair of cams (8*a*) and (8*b*). Rotor (13) is assembled inside the rotary engine (A) in a stabilized way through an anterior bearing (7) and a posterior bearing (9), where rotor (13) is coupled in a way to have a free turn over cams (8*a*) and (8*b*), through anterior bearing, (7) and posterior bearing (9).

Figure 10:
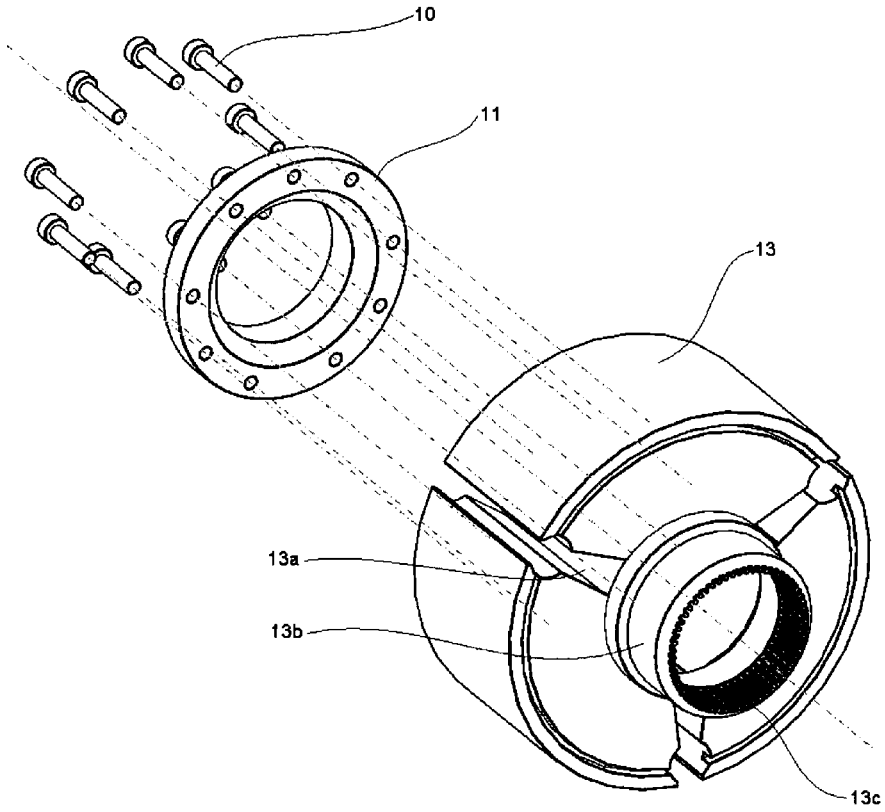
FIG. 10 is an exploded posterior perspective view of one embodiment of the new rotary engine showing the rotor and its closing axial component/bearing base and its fixation elements, and also showing the stationary satellite gear fixed to the rotor.
Figure 11:
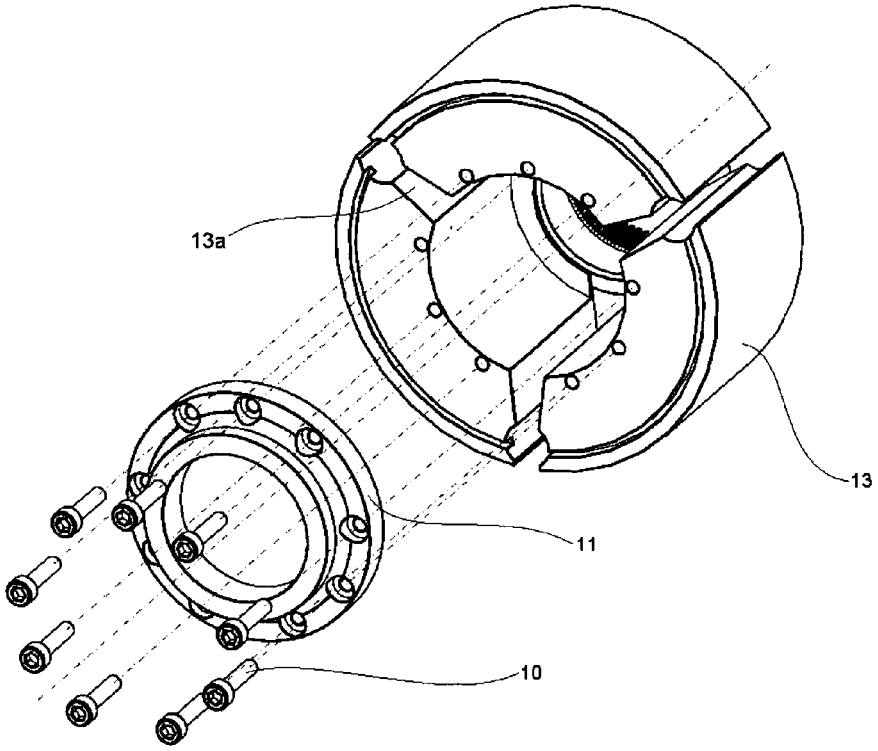
FIG. 11 is an exploded anterior perspective view of one embodiment of the new rotary engine showing the rotor and its closing axial component/bearing base and its fixation elements.
Figure 12:
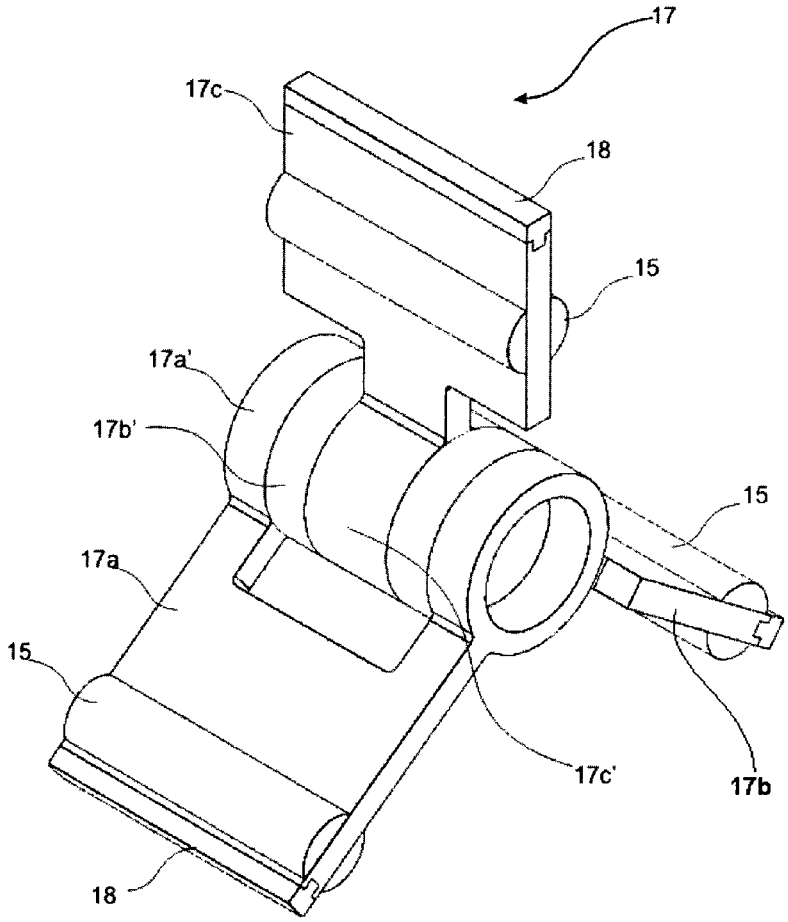
FIG. 12 is a perspective view of one embodiment of the new rotary engine showing the divisors that form the chambers of the new rotary engine.
Figure 13:
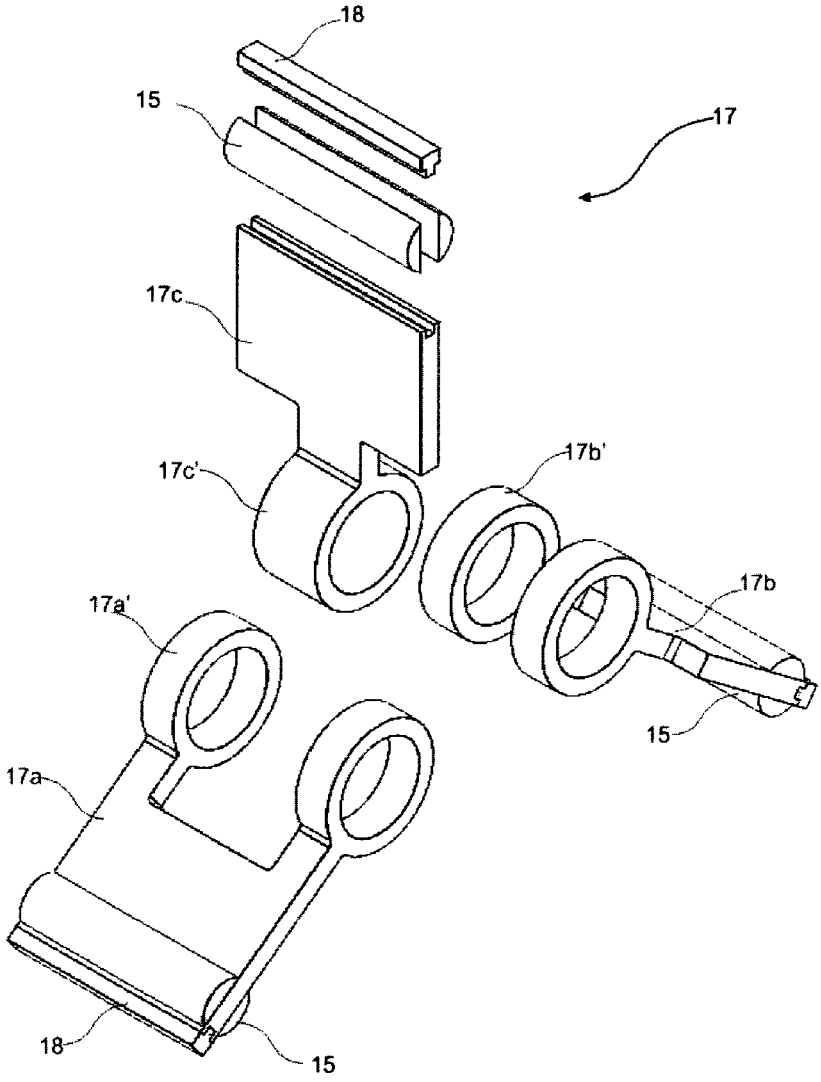
FIG. 13 is an exploded perspective view of one embodiment of the new rotary engine showing the divisors that form the chambers and their pivoted sliding guides.

With reference to FIGS. 10 and 11, rotor (13) presents the shape of a cylindrical solid. Rotor (13) presents at least three transversal fissures (13*a*) of polygonal profile for the passage of divisors (17*a*), (17*b*), and (17*c*) through rotor (13).

The external part the transversal fissures' (13*a*) trapezoidal profile transitions to a transversal cylindrical shape that slidably holds pairs of pivoted sliding guides (15), allowing the mechanical assembly and dynamic operation of rotor (13), divisors (17*a*), (17*b*), (17*c*), and pivoted sliding guides (15).

Rotor (13), divisors set (17), and pivoted sliding guides (15) perfectly fit the internal part of the jacket (6). Rotor (13) has in the anterior part, an anterior closing plate (11), such as a cover, which also serves as basis of assembly for anterior bearing (7) of rotor (13). Divisors (17*a*), (17*b*), and (17*c*) are disposed in a radial way in transversal fissures' (13*a*). Rotor (13) has a neck (13*b*) which has a planetary gear (13*c*) fixed to it, which assures the rotation movement of rotor (13) around its own axis, whose rotation axis coincides with the center of cams (8*a*) and (8*b*) of main axis (8). The rotation movement of rotor (13) around its own axis, and the orbital movement (translation) of it, are combined, synchronized and assured by the interference of the planetary gear (13*c*) with a stationary satellite gear (20) and by the translation movement of cams (8*a*) and (8*b*), where the center of rotor (13) through the anterior bearing (7) and posterior bearing (9) is coupled. Such coupling makes both rotor (13), and cams (8*a*) and (8*b*), describe combined orbits, whose orbital center coincides with the center of main axis (8).

Rotor (13) in its anterior part has an axial seal (12), an anterior closing plate (11) fixed through a plurality of fixation elements (10). Rotor (13) in its posterior part has a second axial seal (14).

The polygonal profile of each transversal fissure (13*a*) of rotor (13) is described by an initial trapezoidal form, whose function is to receive the corresponding divisor (17*a*), (17*b*), (17*c*). In its extreme part, each trapezoidal profile transitions to a cylindrical form, where in the transition region of each transversal fissure (13*a*), pivoted sliding guides (15) of divisors set (17) are slidably held in a way that the divisors (17*a*), (17*b*) and (17*c*) of divisors set (17) may follow all movements of rotor (13) without interferences.

Divisors set (17) is physically defined by three divisors (17*a*), (17*b*) and (17*c*), which are assembled with ring-like elements (17*a*'), (17*b*') and (17*c*'), disposed in a parallel way. Divisors set (17) is assembled in the median region of the body of main axis (8) and is delimited by cams (8*a*) and (8*b*). At the end of each divisor (17*a*), (17*b*) and (17*c*), a radial seal (18) is provided. The function of the radial seals (18) is to optimize the sealing between the chambers during the movements, described by the end of each divisor (17*a*), (17*b*) and (17*c*) of divisors set (17) and radial seals (18) in relation to the internal wall of jacket (6). Axial seals (16) are disposed on the side of each divisor (17*a*), (17*b*) and (17*c*).

Figure 7:
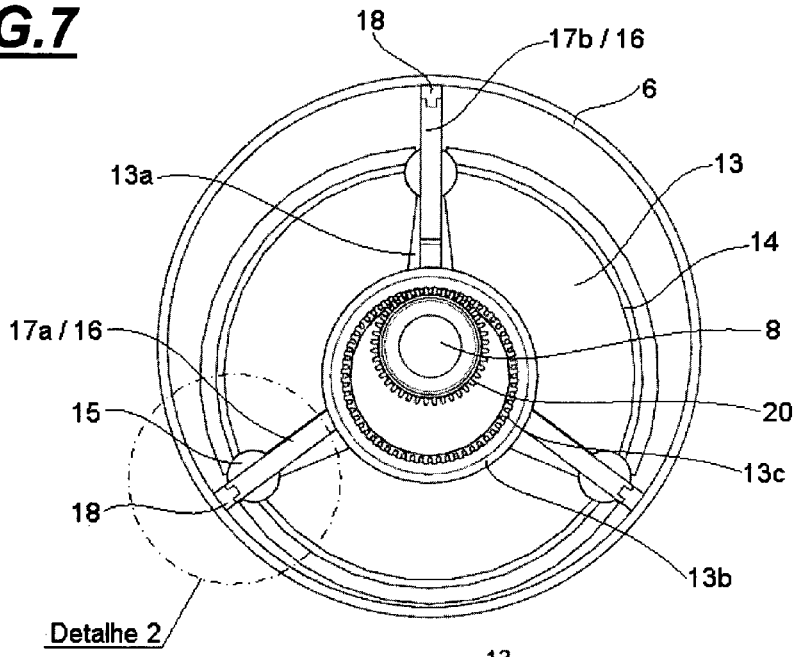
FIG. 7 is a frontal view without the posterior closing plate, showing one embodiment of the new rotary engine, revealing its dynamic parts.

In the external part of each divisor (17*a*), (17*b*) and (17*c*), a pivoted sliding guide (15) connects the divisor (17*a*), (17*b*) and (17*c*) with the rotor (13). Pivoted sliding guides (15) assure the stability of the divisors (17*a*), (17*b*) and (17*c*) inside the transversal fissures (13*a*) of rotor (13). Pivoted sliding guides (15) also assure the correct placement of the divisors (17*a*), (17*b*) and (17*c*) in relation to the rotor (13) during the entire cycle of rotor (13), where each pair of subsequent divisors (17*a*), (17*b*) and (17*c*) associated to the rotor (13) forms a chamber, which is comprised among this pair of subsequent divisors (17*a*), (17*b*) and (17*c*), the sector of rotor (13) defined between this pair of subsequent divisors (17*a*), (17*b*) and (17*c*), and the sector of jacket (6) defined between this pair of subsequent divisors (17*a*), (17*b*) and (17*c*), during the entire functional cycle of rotary engine (A), as shown in FIG. 7, when rotary engine (A) performs the phases of an internal combustion engine.

Applied functional kinematics: the kinematics obtained from the rotary engine (A) describe the following functional phases:

$1^{st}$) Maximal intake;

$2^{nd}$) Compression;

$3^{rd}$) Explosion;

$4^{th}$) Expansion;

$5^{th}$) Depletion; and $6^{th}$) Final and initial flow of intake.

The kinematics described by rotary engine (A) starts from the action of the main axis (8), of crankshaft type which, leads rotor (13) to describe an orbital movement around the internal diameter of jacket (6) by the action of planetary gear (13*c*) fixed to rotor (13) over stationary satellite gear (20). This leads rotor (13) in a rotation movement around its own center, this center coincides with the center of cams (8*a*) and (8*b*) of main axis (8) in all phases of the functional cycle of rotary engine (A). The synchronized combination of these movements makes the chambers, formed between the rotor (13), divisors set (17) and jacket (6), sequentially describe the phases of the functional cycle of internal combustion engines (two- and four-stroke-cycle).

Figure 14:
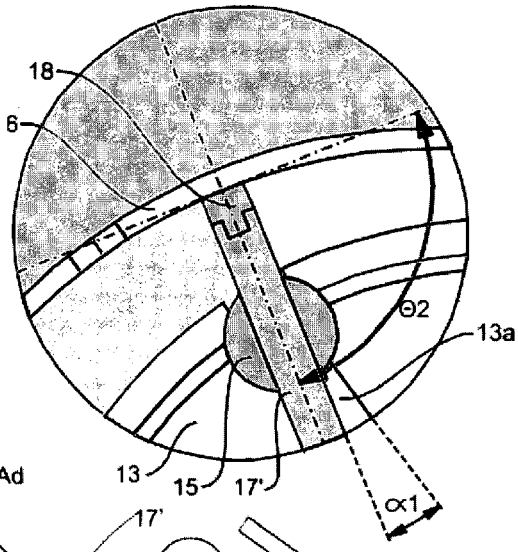
FIG. 14 is an illustrative representation of the functional cycle of one embodiment of the new rotary engine performed by one of the three chambers in the final phase of maximal intake.
Figure 14:
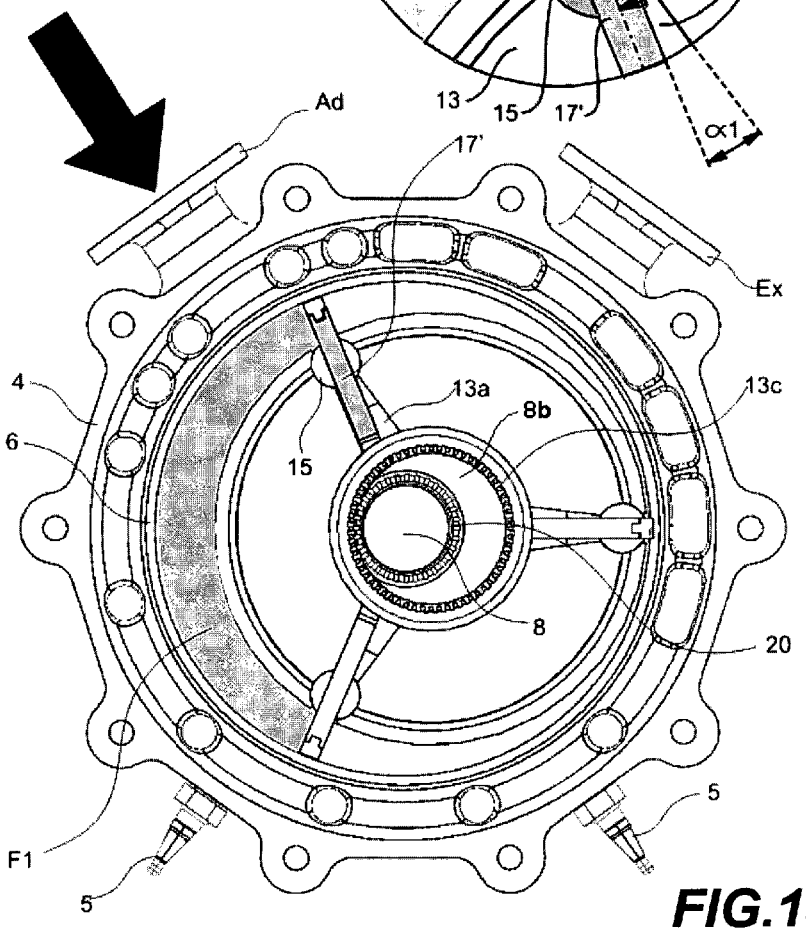

For a better understanding of the functional cycle of rotary engine (A), this cycle is illustrated in the FIGS. 14, 15, 16, 17 and 18, respectively, where the following phases are described:

$1^{st}$) Initial phase of maximal intake: in this phase the combustible/comburent mixture is admitted through intake nozzle (Ad), entering in chamber (F1) comprised between the rotor (13), jacket (6) and two subsequent divisors (17). When rotor (13) is deviated from the internal cylindrical face of jacket (6), chamber (F1) increases its volume and is filled with the combustible/comburent mixture, as shown in FIG. 14. Divisor (17'), describes a permanent perpendicular angle (Θ2) equal to 90° in relation to the internal surface of jacket (6), during a 360°-turn of the divisor (17) inside jacket (6). As it turns, divisor (17) keeps this perpendicular angle since divisor (17') is assembled by its rings to the median part of main axis (8), in a way to freely rotate around main axis (8) and to have its rotation center coincide with the center of main axis (8), which is also the rotation center of main axis (8) which coincides with the center of jacket (6). It may be seen that the divisor (17') must axially displace inside the transversal fissure (13*a*), where during this initial phase the divisor (17') is tangent to one wall of the transversal fissure (13*a*) and forms an angle ($\alpha_1$) between divisor (17') and the opposed wall of transversal fissure (13*a*), as shown in the amplified details in FIG. 14.1, where it is possible to see that divisor (17') follows the displacement of rotor (13) and is kept in a constant normal position (Θ2) equal to 90° in relation to the internal wall of jacket (6), during the movements of translation and rotation of rotor (13). The positions of the divisor (17') in relation to rotor (13) are assured through the sliding/oscillating connection of pivoted sliding guides (15).

Figure 15:
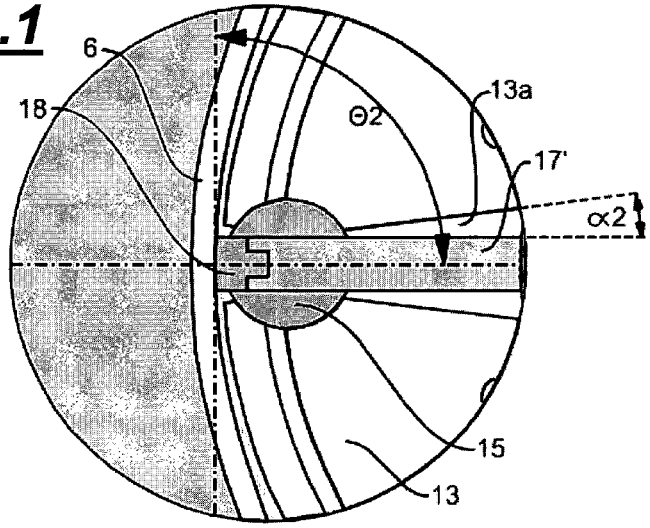
FIG. 15 is an illustrative representation of the functional cycle of one embodiment of the new rotary engine performed by one of the three chambers in the phase of compression.
Figure 15:
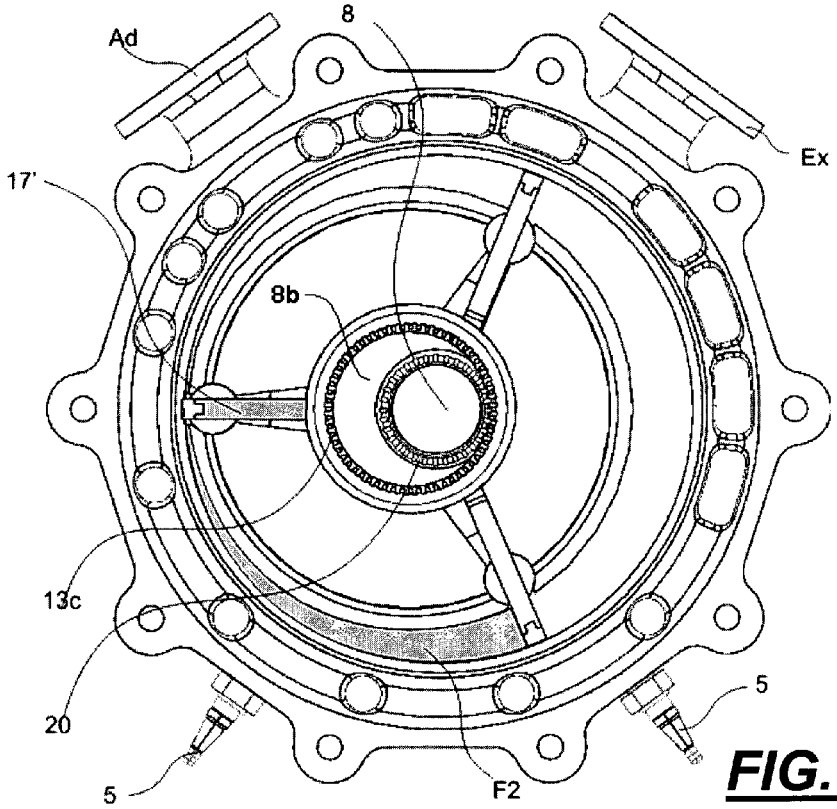

$2^{nd}$) Phase of compression: in this phase a combustible/comburent mixture is admitted through intake nozzle (Ad) and is progressively compressed by the external cylindrical face of rotor (13), comprised between two subsequent divisors (17), approaching the internal cylindrical face of jacket (6), to the limit point of the formation of chamber (F2), that has a reduced volume compared to the volume of the phase of maximal intake (F1). The divisor (17') keeps the perpendicular angle (Θ2) equal to 90° in relation to the internal surface of jacket (6), as shown in FIG. 15. We can also see that divisor (17') follows the displacement of rotor (13) and is kept in a normal constant position (Θ2) equal to 90° in relation to the internal wall of jacket (6) during the translation and rotation movements of rotor (13). The position of the divisor (17') in relation to rotor (13) is assured through the sliding/oscillating connection of pivoted sliding guide (15). As the rotary engine turns, it is possible to see that to follow the movements of rotor (13) inside jacket (6), divisor (17') must axially displace inside transversal fissure (13*a*) of rotor (13), where in this compression phase it particularly is in the middle point between the two walls of transversal fissure (13*a*), describing an angle ($\alpha_2$) between divisor (17') and the walls of transversal fissure (13*a*), as shown in the amplified details in FIG. 15.1.

Figure 16:
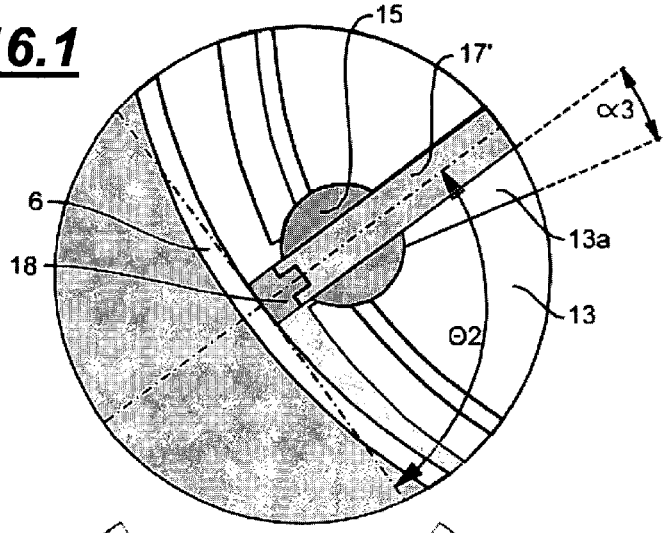
FIG. 16 is an illustrative representation of the functional cycle of one embodiment of the new rotary engine performed by one of the three chambers in the phase of maximal compression and explosion.
Figure 16:
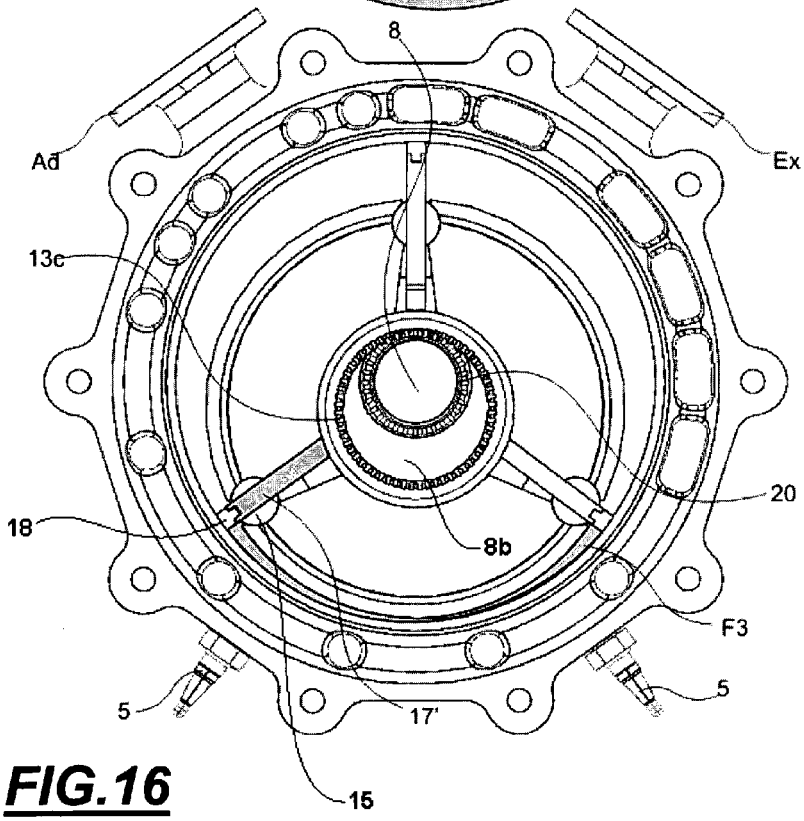

$3^{rd}$) Phase of explosion: in this phase, the combustible/comburent mixture is progressively compressed until the limit of the formation of a forked chamber (F3), where the volume of this chamber is extremely reduced, and where the explosion of the mixture occurs through the generation of sparks by spark plug (5) or by self-combustion, and where the perpendicular angle (Θ2) is kept equal to 90° between divisor (17') and the internal surface of jacket (6), as shown in FIG. 16. Divisor (17') follows the displacement of rotor (13) and is kept in a constant normal position (Θ2) equal to 90° in relation to the internal wall of jacket (6) during the translation and rotation movements of rotor (13), and the position of the divisor (17') in relation to rotor (13) is assured through the sliding/oscillating connection of pivoted sliding guide (15). As the rotary engine turns it is possible to verify that to conveniently follow rotor (13) movements inside jacket (6), divisor (17') must axially displace inside transversal fissure (13*a*) of rotor (13), where in this particular phase of explosion, divisor (17') is tangent to one wall of transversal fissure (13*a*) and forms an angle ($\alpha_3$) between divisor (17') and the opposed wall of transversal fissure (13*a*), as shown in the amplified details in FIG. 16.1.

Figure 17:
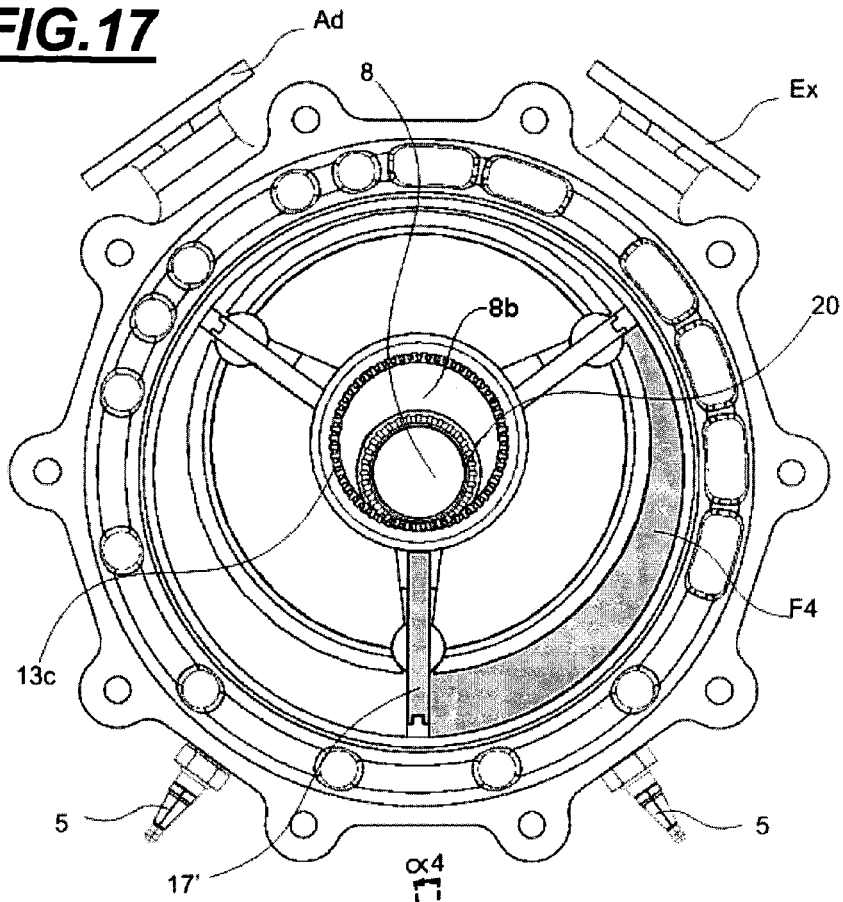
FIG. 17 is an illustrative representation of the functional cycle of one embodiment of the new rotary engine performed by one of the three chambers in the medium phase of expansion.
Figure 17:
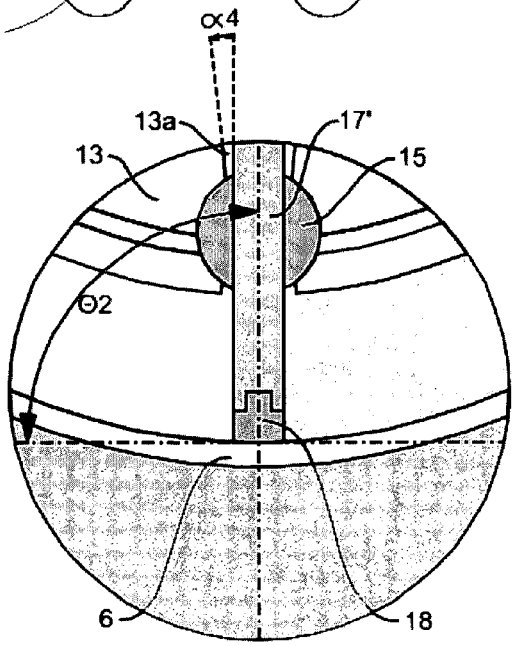

4$^{th}$) Phase of expansion: in this phase, with the previous action of the explosion of the combustible/comburent mixture and with the continuous displacement of rotor (13) and divisors set (17), the formation of an expansion chamber (F4) occurs between divisors set (17) and jacket (6), when in this phase, rotor (13) receives an impulse from the expansion of the gas under high pressure and is forced to displace, transferring the force of this impulse to cams (8*a*) and (8*b*) of main axis (8), obligating main axis (8) to rotate around its center, creating the engine moment of the cycle. During this cycle the volume of chamber (F4) passes from extremely compressed to extremely amplified, as a consequence of the displacement of rotor (13) and divisors set (17), which form chamber (F4). The perpendicular angle (Θ2) is kept equal to 90° between the divisor (17') and the internal surface of jacket (6), as shown in FIG. 17, which illustrates chamber (F4) during the expansion phase. As the rotary engine turns it is possible to verify that to follow the movements of rotor (13) inside jacket (6), divisor (17') must axially displace inside transversal fissure (13*a*), where in this particular phase of expansion it is in the middle point between the two walls of the transversal fissure (13*a*), forming an angle ($\alpha_4$) between divisor (17') and the walls of transversal fissure (13*a*), as shown in the amplified details in FIG. 17.1. Divisor (17') follows the displacement of rotor (13) and is kept in a constant normal position (Θ2) equal to 90° in relation to the internal wall of jacket (6) during the movements of translation and rotation of rotor (13). The position of the divisor (17') in relation to rotor (13) is assured through the sliding/oscillating connection of pivoted sliding guide (15).

Figure 18:
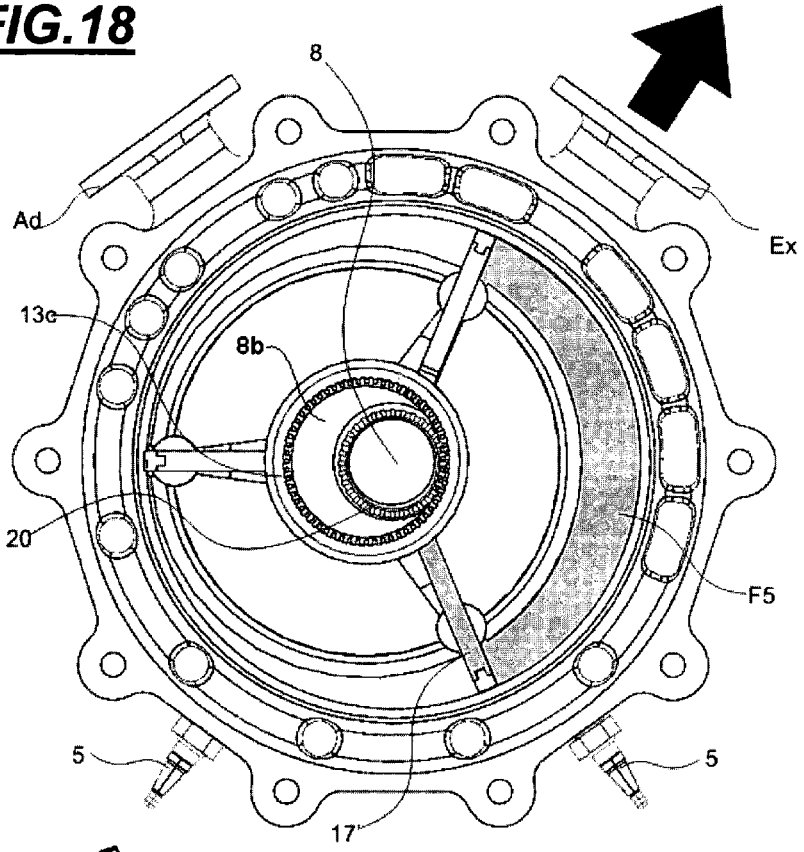
FIG. 18 is an illustrative representation of the functional cycle of one embodiment of the new rotary engine performed by one of the three chambers in the phase of maximal expansion and initial phase of depletion.
Figure 18:
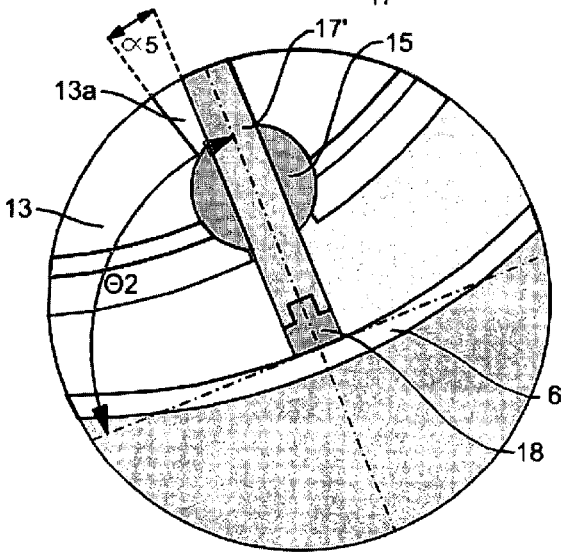

5$^{th}$) Phase of depletion: in this final phase of expansion, the burned gas starts to be exhausted through depletion nozzle (Ex) at the limit point of formation of a chamber (F5) in maximal expansion, as shown in FIG. 18, such that the perpendicular angle (Θ2=90°) is kept between the divisor (17') and the internal surface of jacket (6), as shown in amplified details in FIG. 18.1. As the rotary engine turns, it is possible to verify that to follow the movements of rotor (13) inside jacket (6), divisor (17') must axially displace inside the transversal fissure (13*a*), where in this phase of depletion divisor (17') is tangent to one of the wall of transversal fissure (13*a*) and forms an angle ($\alpha_5$) between divisor (17') and the opposed wall of transversal fissure (13*a*), as shown in the amplified details in FIG. 18.1. Divisor (17') follows the displacement of rotor (13) and is kept in a constant normal position (Θ2) equal to 90° in relation to the internal wall of jacket (6) during the movements of translation and rotation of rotor (13). The position of divisor (17') in relation to rotor (13) is assured through the sliding/oscillating connection of pivoted sliding guide (15).

Figure 19:
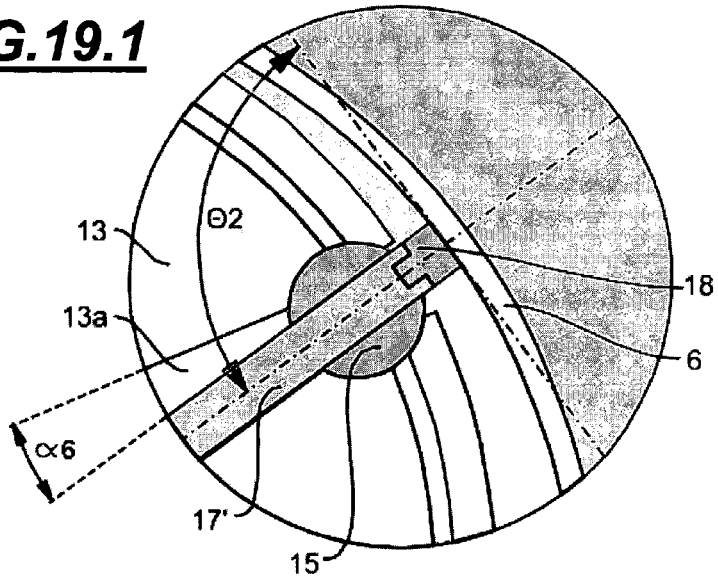
FIG. 19 is an illustrative representation of the functional cycle of one embodiment of the new rotary engine performed by one of the three chambers in the final phase of depletion and start of intake.
Figure 19:
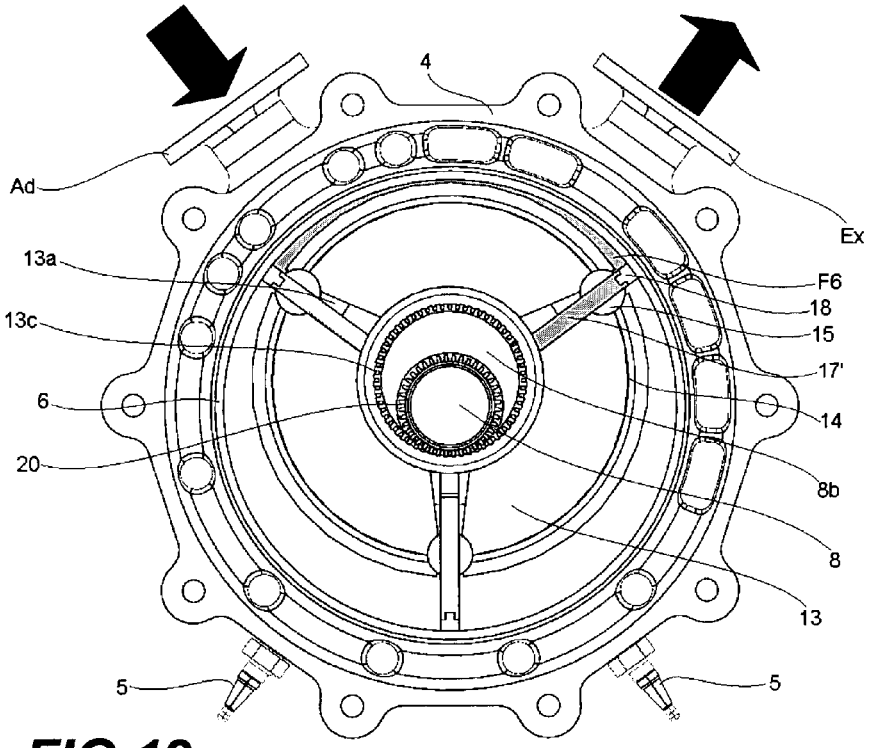

6$^{th}$) Final phase of depletion and initial phase of a new cycle: in this phase the two subsequent divisors (17), in a combined movement with rotor (13), rotate until the limit point of a forked chamber (F6), where the volume of chamber (F6) is again extremely reduced, as shown in FIG. 19, when the gas from the burned mixture is totally discharged through depletion nozzle (Ex), completing the cycle performed by chamber (F6), starting a new cycle of chamber (F6). The perpendicular angle (Θ2) is kept equal to 90° between the divisor (17') and the internal surface of jacket (6), as shown in FIG. 19.1. During the movements of translation and rotation of rotor (13), the positions of the divisor (17') in relation to rotor (13) are assured through the sliding/oscillating connection of pivoted sliding guide (15).

The kinematics described by the angular movement (a) of the divisor (17') related to the internal walls of transversal fissure (13*a*) of rotor (13) occurs due to the combination of the movement described by main axis (8), which by being a crankshaft-type piece makes cams (8*a*) and (8*b*) describe an orbital movement, whose orbit center coincides with the center of main axis (8), forcing and consequently driving rotor (13) to follow this orbital movement. The rotation movement of rotor (13) is driven and results from the interference of stationary planetary gear (13*c*) with stationary satellite gear (20) fixed to rotor (13). Divisor set (17) follows the movements of translation and rotation of rotor (13) in its entire route during its complete 360°-cycle, effectively keeping the radial tangency of each divisor (17*a*), (17*b*), and (17*c*) of the divisors set (17) normal to the internal cylindrical surface of jacket (6), i.e., (Θ2=90°) during the entire 360°-cycle. This is made possible by the form of pivoted sliding guides (15) between rotor (13) and divisors set (17), whose couplings allow the free movement between these components.

For the present application, divisor (17') it must be understood as all divisors (17*a*), (17*b*) and (17*c*) that are highlighted in FIGS. 14, 14.1, 15, 15.1, 16, 16.1, 17, 17.1, 18 and 18.1. The divisors set (17) of divisors (17*a*), (17*b*) and (17*c*) describes a circular movement, whose rotation center coincides with the center of the cylindrical jacket (6), assuring the maintenance of the perpendicular angle (Θ2=90°) of the end of divisors (17*a*), (17*b*) and (17*c*) in relation to the internal surface of jacket (6), and also describes angular movements ($\alpha_1$), ($\alpha_2$), ($\alpha_3$), ($\alpha_4$) and ($\alpha_5$) in relation to the walls of the transversal fissures (13*a*), assuring the free relative movement between rotor (13) and divisors (17*a*), (17*b*) and (17*c*).

The embodiments of rotary engine (A) described in this application are only provided as an example. Changes, modifications and variations of the basic rotary engine (A) may be performed, mainly when the divisors set (17) of the chambers is formed by two, three, four, five, six or several divisors (17'), where the rotor (13) may present all kinds of geometric or organic forms.

Rotary engine (A) also allows a plurality of arrangements that define a plurality of chambers associated to a plurality of divisors (17'), having one or a plurality of rotors (13), with one or a plurality of coherent relations between planetary gear (13*c*) and stationary satellite gear (20), defining one or a plurality of motor cycles, two- or four-stroke, to each complete turn of rotor (13) and one or a plurality of rotors (13) coupled or not in a parallel way, driving one or a plurality of main axis (8), directly coupled among themselves or not.

The above-described embodiments of the present application are meant to be illustrative of preferred embodiments of the present application and are not intended to limit the scope of the present invention. Various modifications, which would be readily apparent to one skilled in the art, are intended to be within the scope of the present application.

The invention claimed is:

1. A rotary engine comprising:

(A) a housing comprising:

a main block with a cylindrical cavity forming a void internal volume, inside which are mounted a rotor and a set of divisors;

an intake nozzle for receiving air/combustible mixture;

a depletion nozzle for exhausting burned gases;

an anterior cover plate having a central seat that receives a bearing to support the anterior end of a main axis;

a posterior cover plate having a central seat that receives a bearing to support the posterior end of the main axis;

(B) the main axis having:

at least one cylindrical cam where the rotor is mounted by bearings, the rotor is free to turn on the at least one cylindrical cam;

when the main axis rotates on its center line, a center line of the cam rotates in a circular orbit movement and drags the rotor to perform the same circular orbital movement whose orbit center is coincident with the center line of the main axis;

at least one cylindrical portion with a center line concentric with the center line of main axis, the at least one cylindrical portion being concentric with a center line of a jacket, the at least one cylindrical portion being connected to the divisors that rotate through their bearings; and at least one support bearing mounted in the central part of one of the anterior cover plate, posterior cover plate and other static element of housing to stabilize the main axis;

(C) at least two divisor sets, each divisor set including:

at least a body of a divisor component that includes a radial seal, the at least the body of the divisor component slides adjacent and perpendicular to inner surface of jacket, and each body of the divisor component sliding on the pivoted sliding guide of rotor;

at least one set of axial seals in the sides of each divisor, the at least one set of axial seals sliding adjacent and over the surfaces of the anterior and posterior cover plates; and each divisor having at least one bearing in connection with the main axis, the center line of the bearing being coincident with the main center line of main axis and the center line of the jacket; and (D) a cylindrical rotor comprising:

a cylinder having a plurality of transversal fissures, each transversal fissure having an initial trapezoidal opening and a cylindrical opening that receives the pivoted sliding guide;

at least two of the plurality of transversal fissures being disposed radially equidistant among themselves, each transversal fissure receiving an assembly of one of the divisor set, which during rotation, drags the divisors to maintain the radial seals perpendicular to an inner surface of the jacket;

at least one bearing for connecting at least one cylindrical cam of main axis;

a rotatable satellite gear with internal teeth whose diameter is wider than a stationary planetary gear, the rotatable satellite gear being engaged with external teeth of the stationary planetary gear, the stationary planetary gear being fixed to the cover plate;

engagement of the satellite gear and stationary planetary gear providing at least two synchronized movements including rotational and orbital movement, the stationary planetary gear being fixed to the cover plate, the orbital movement provided by the rotation of cam of crankshaft; and the stationary planetary gear with external teeth having a central hole through which one end of the main axis passes freely, the stationary planetary gear being fixed to the cover plate with the center line of the stationary planetary gear being coincident with the center line of the main axis, the planetary gear having fewer teeth than the satellite gear of rotor.

2. The rotary engine according to claim 1, wherein the ratio between the movable satellite gear and the stationary planetary gear is based on the number of changes of the rotary engine, each chamber being confined between two divisors;

the ratio being 2:1 for a two chamber rotary engine;

the ratio being 1.5:1 for a three chamber rotary engine; and the ratio being 1.25:1 for a four chamber rotary engine.

3. The rotary engine according to claim 1, wherein the planetary gear performs cycloidal movements around the satellite gear during operation of motor.

4. The rotary engine according to claim 1, wherein the rotary engine performs one of two and four strokes of an internal combustion engine by the rotor moving away and toward the internal surface of the jacket to decrease and increase the volume of at least one chamber; and each of the at least one chamber is formed by a volume contained and confined among a pair of divisors, a portion of the inner jacket, a portion of outer surface of the rotor and by portions of covers plates defined by each pair of the divisors.

5. The rotary engine according to claim 1, wherein the at least two transversal fissures each receive a mounting of the set of divisor.

6. The rotary engine according to claim 1, wherein the at least one divisor comprises at least two sets of axial seal.

7. The rotary engine according to claim 1, wherein has at least two divisors of chambers, each divisor having at least one bearing for connection to the main axis.

8. The rotary engine according to claim 7, wherein the bearings for connection of the divisors are mounted on a cylindrical median region of the main axis, the bearings for connection being coaxially and in parallel to the main axis.

9. The rotary engine according to claim 1, wherein the anterior cover plate is connected to the main block through of fixing elements.

10. The rotary engine according to claim 1, wherein the divisors are separate and independent from one another, each having a bearing connection to the main axis.

11. The rotary engine according to claim 1, wherein the posterior cover plate is connected to the main block through of fixing elements.

12. The rotary engine according to claim 1, wherein the radial seal of divisors slide against the jacket to avoid leaks and clean the inner surface of the jacket.

13. The rotary engine according to claim 1, wherein the rotor comprises a neck with a seat to receive at least one bearing through which the rotor is mounted on the main axis.

14. The rotary engine according to claim 1, wherein the rotor includes at least three transversal fissures radially disposed substantially one of:

120 degrees from one another for a rotary engine of three chambers;

180 degrees from one another for a rotary engine of two chambers; and 90 degrees from one another for a rotary engine of four chambers.

* * * * *